US006982372B2

(12) United States Patent
England

(10) Patent No.: US 6,982,372 B2
(45) Date of Patent: Jan. 3, 2006

(54) ACOUSTIC MUSICAL INSTRUMENT AND METHOD

(76) Inventor: Garnett B. England, 1708 McDonald Rd., Leitchfield, KY (US) 42754

( * ) Notice: Subject to any disclaimer, the term of this patent is extended or adjusted under 35 U.S.C. 154(b) by 60 days.

(21) Appl. No.: 10/726,489

(22) Filed: Dec. 4, 2003

(65) Prior Publication Data

US 2005/0120859 A1 Jun. 9, 2005

(51) Int. Cl.
*G10D 3/00* (2006.01)

(52) U.S. Cl. ..... 84/290

(58) Field of Classification Search ..... 84/297 R, 84/298, 299, 307, 290, 291, 267, 312 P, 319
See application file for complete search history.

(56) References Cited

U.S. PATENT DOCUMENTS 4,951,543 A * 8/1990 Cipriani ..... 84/298
5,465,643 A 11/1995 Beeson
5,686,677 A * 11/1997 Herbert ..... 64/307
6,040,510 A 3/2000 Yaun

FOREIGN PATENT DOCUMENTS

DE 3924726 2/1991

* cited by examiner

*Primary Examiner*—Kimberly Lockett
(74) *Attorney, Agent, or Firm*—Richard C. Litman

(57) ABSTRACT

An acoustic musical instrument includes a sounding board which has a top and a bottom surface. The top includes a bridge and the bottom includes a plurality of tone bars. A string block extends between two of the tone bars and is spaced from said sounding board. The string block includes means for anchoring at least one string end. The instrument is strung by anchoring a first end of each string to the string block and attaching a second end of each string to a tensioning device.

8 Claims, 4 Drawing Sheets

ACOUSTIC MUSICAL INSTRUMENT AND METHOD

BACKGROUND OF THE INVENTION

1. Field of the Invention

The present invention relates to an acoustic musical instrument. More particularly, the invention relates to a hollow body stringed instrument having enhanced sonic properties and a method of anchoring string ends to the instrument.

2. Description of the Related Art

Typically, hollow body acoustic stringed musical instruments include a plurality of strings disposed in tension from a head stock or other string fastening or tension-adjusting device to a bridge disposed on or near a hollow body defining a sounding chamber. In some cases, the strings are stretched over the bridge and extend to a tailpiece or other anchoring mechanism.

FIG. 2 shows a cutaway view of a prior art steel stringed guitar 10. Strings 12 extend from a headstock (not shown in FIG. 2) to bridge plate 24. Bridge plate 24 has holes 18 extending therethrough aligned with holes in sounding board top 17 (not visible). As is generally known, bridge pins 25 or other means are then used to secure the string ends to the bridge plate 24, which is attached to sounding board top 17. The tension of strings 12 generates a large torque and shear stress against sounding board top 17. To strengthen and improve sonic properties of sounding board top 17, a plurality of tone bars (not visible in FIG. 2) are disposed in some predetermined arrangement on the underside of sounding board top 17.

All aspects of the construction, materials, and design of the body of an acoustic hollow body instrument affect the resonance generated within the body of the instrument, which markedly alters the overall sound generated. A variety of techniques have been implemented to attach the string ends to the body of acoustic musical instruments, but none have proven to provide a marked improvement in volume or tone.

For example, U.S. Pat. No. 6,040,510, issued Mar. 21, 2000 to Yaun, shows an acoustic hollow body guitar having strings connected at their tail end to a "bridge base" or tailpiece, which is secured to the tail end of the guitar. The guitar strings are stretched over a bridge which is fixed to a "vibration transmitting block" positioned just under the bridge inside the sounding chamber. This vibration transmitting block is then connected to various "bottom blocks" by coil springs in tension. The coil springs are designed to enhance the sound by adding a reverberation effect, which is said to also increase volume level. Note that the tail end of the guitar strings are not directly attached to the vibration transmitting block and the vibration transmitting block is fixed against the underside of the sounding board top just under the bridge. While this configuration may alter the sound generated by the guitar by adding a reverberation effect, it does not enhance and improve the clarity of the sound as desired by the present inventor.

German Patent No. 3,924,736, published Feb. 21, 1991, shows a guitar having a string anchoring arrangement where the strings are anchored to the underside of a block that is fitted into a groove formed in the body of the guitar. While this may improve the strength and appearance of the guitar string anchor, there is no suggestion that it improves the sonic properties of the guitar, nor is it suggested that it is suitable for a hollow-body acoustic musical instrument.

U.S. Pat. No. 5,465,643, issued Nov. 14, 1995 to Beeson, shows a string support located between the saddle block of a guitar tremolo and each string passing over the saddle block. In this case, the string is retained using a retaining screw operated device to reduce string breakage. There is no suggestion that the volume and tone are improved using this device, nor does it appear to be intended for a hollow body acoustic musical instrument.

None of the above inventions and patents is seen to describe the instant invention as claimed. Thus, the acoustic musical instrument solving the afore-mentioned problems is desired.

SUMMARY OF THE INVENTION

The acoustic musical instrument of the present invention provides a marked improvement in volume and tone. The present instrument includes a sounding board which has a top and a bottom surface. The top surface includes a bridge and the bottom surface includes a plurality of tone bars. A string block extends between two of the tone bars and is spaced from the sounding board. The string block includes means for anchoring at least one string end. The instrument is strung by anchoring a first end of each string to the string block and attaching a second end of each string to a tensioning device.

Accordingly, it is a principal object of the invention to provide a hollow body stringed musical instrument having improved volume and/or tonal qualities.

It is another object of the invention to provide an acoustic musical instrument having improved volume and/or tonal qualities without significantly altering the aesthetic appearance of the instrument.

It is a further object of the invention to provide an improved hollow body stringed instrument without significantly increasing the cost of manufacture.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
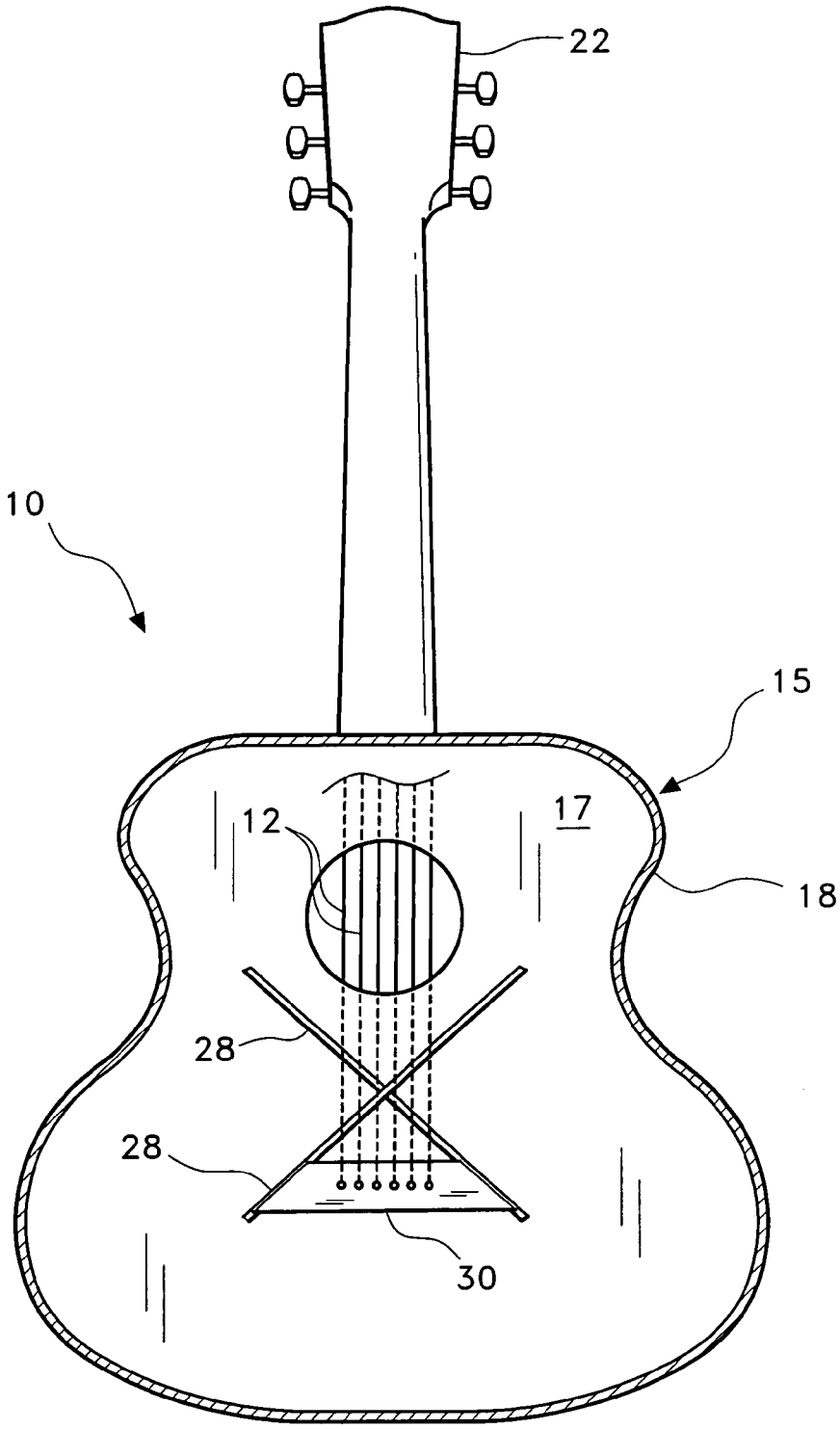
FIG. 1 is a bottom cross-section view of an acoustic instrument according to the present invention.
Figure 2:
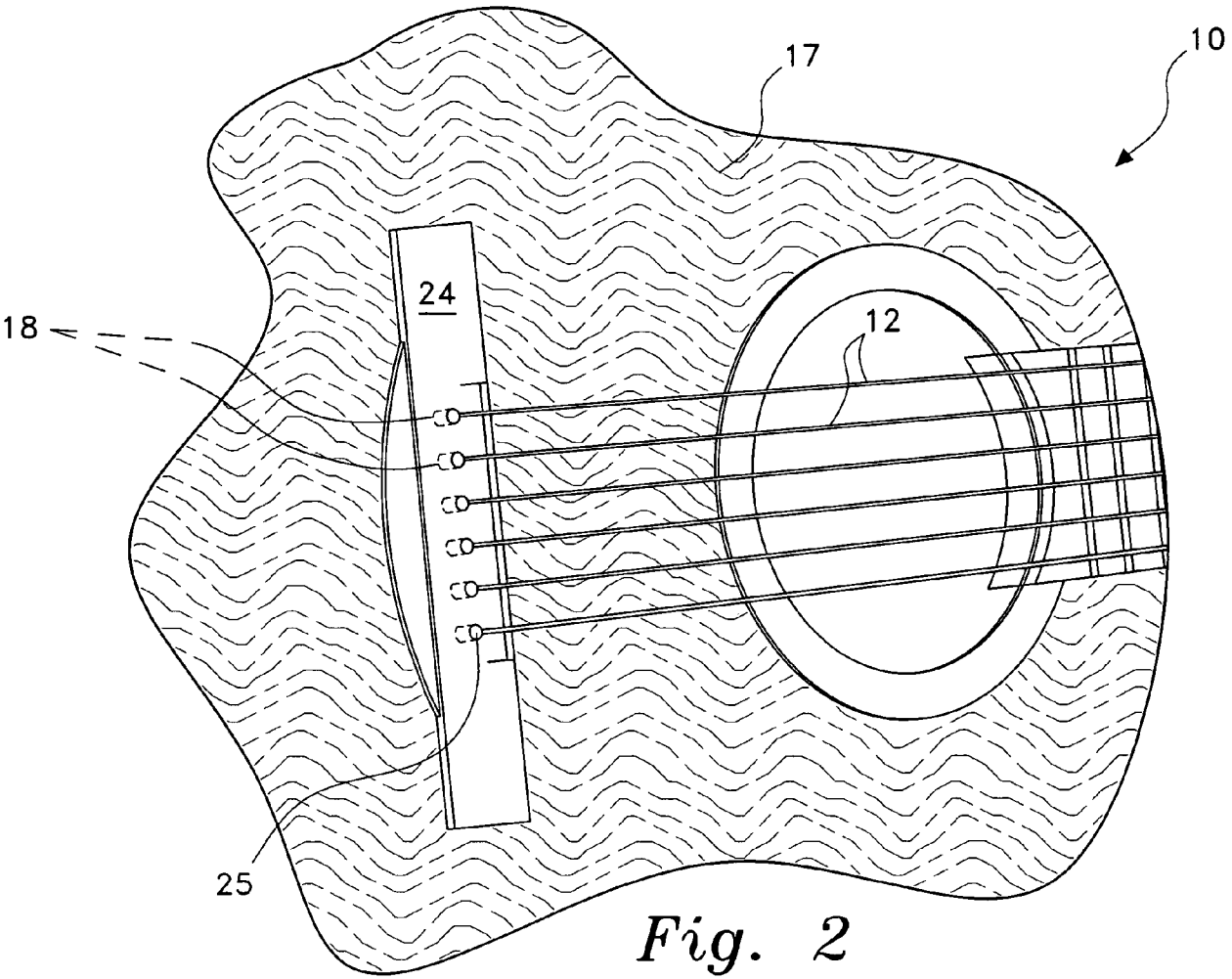
Fig. 2 (PRIOR ART)
FIG. 2 shows a fragmented top view of a prior art steel-stringed guitar.

Referring to FIG. 1, an acoustic stringed instrument is shown generally at 10. "Acoustic stringed instrument," in the context of this application, may include any hollow body acoustic stringed musical instrument that uses or may use tone bars to reinforce the sounding board top 17 or improve tonal quality of the instrument. Examples of such stringed instruments include guitars, mandolins, lutes, ukuleles, and fiddles. Acoustic stringed instrument 10 is shown as a guitar by way of example only and comprises a hollow body 15 having a sounding board top 17 (viewed from underneath), sides 18, and a bottom (not shown in FIG. 1). Strings 12 are disposed in tension across sounding board top 17 of stringed instrument 10. Each string 12 is attached at a first end to a head stock 22 or other fastening or tensioning device as is generally known in the art.

At a second end or tail end, what will now be referred to simply as "the string end" passes over bridge plate 24 (shown in FIGS. 3, 4) and is fastened or anchored to string block 30

Figure 3:
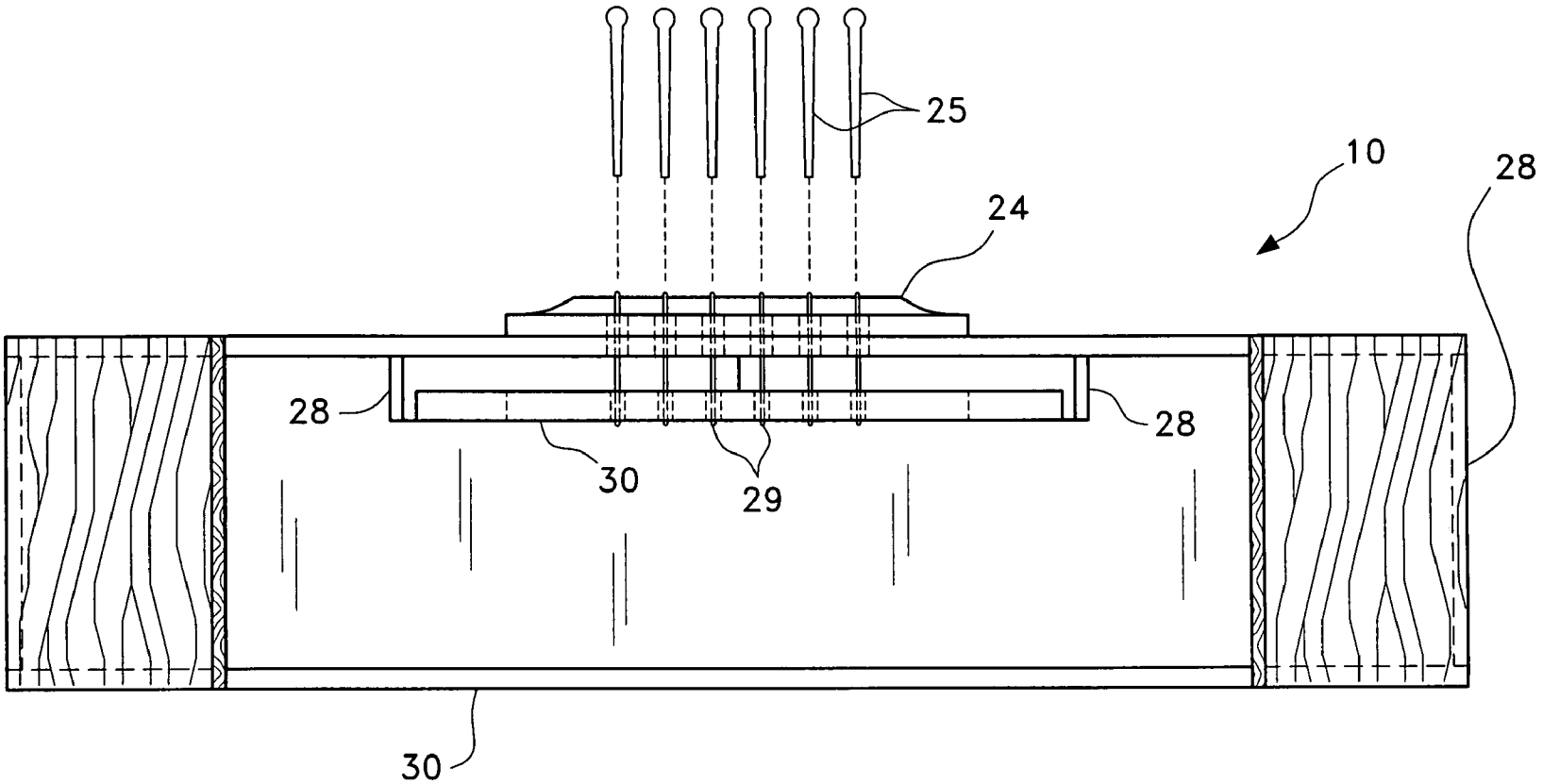
FIG. 3 shows a cross-section view of the sounding chamber looking from the tail end of the acoustic musical instrument of the present invention, including a profile view of the bridge and string connection.
Figure 4:
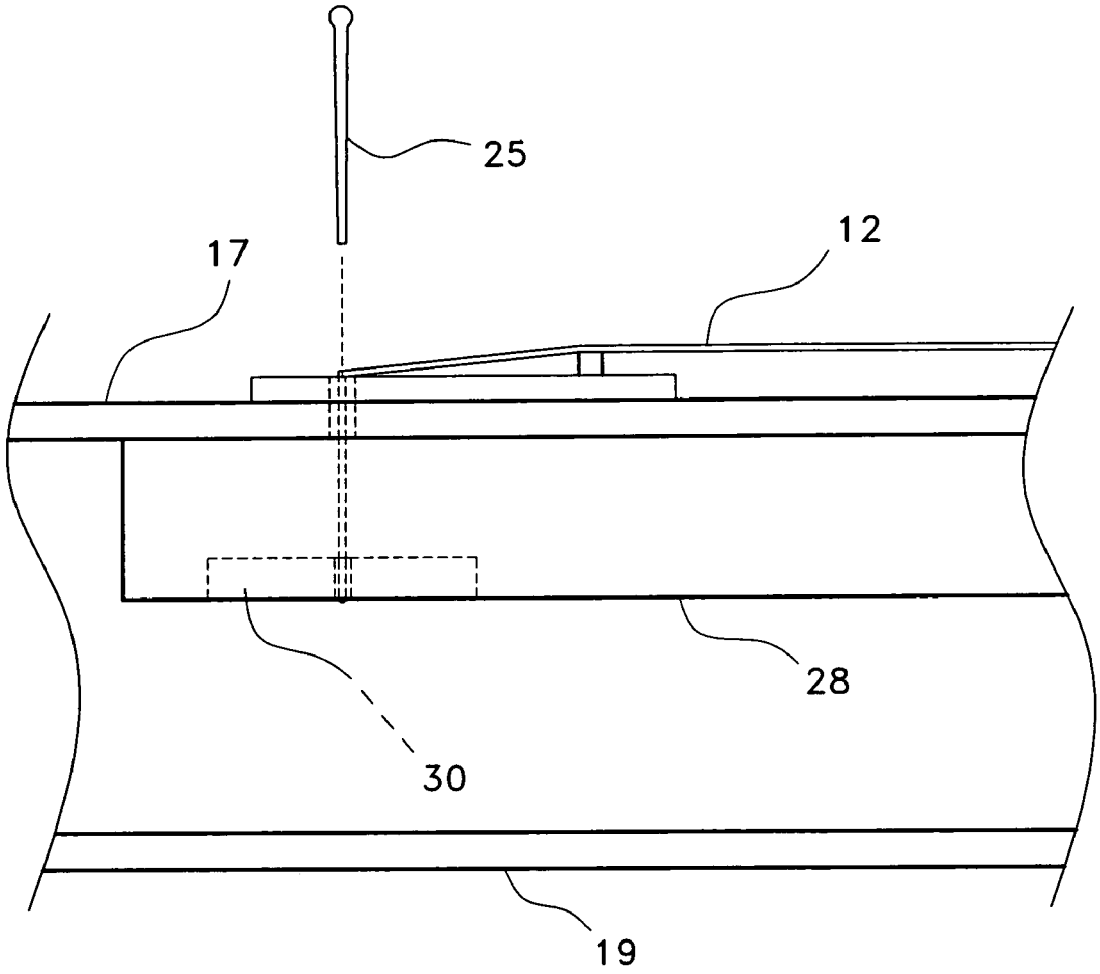
FIG. 4 shows a fragmented diagrammatic side view of the sounding chamber of the acoustic musical instrument according to the present invention.

String block 30 rests against or is attached to tone bars 28 and is thereby spaced from sounding board top 17 by tone bars 28. As shown in FIGS. 1, 3 and 4, string block 30 is preferably notched into tone bars 28, i.e., tone bars 28 have notches formed therein which receive and support string block 30. An adhesive (not shown) or other known means may be used to assist in retaining string block 30. As is generally known in the art of guitar manufacture and discussed above, tone bars 28 are essentially braces that strengthen the top and also, because of their positioning and dimensions, have a profound effect on the sonic properties of the guitar. Depending on the type of instrument, one or more tone bars 28 may be added to the traditional design and/or rearranged to accommodate string block 30.

String block 30 includes an anchor point 29 for each string 12. Many musical instruments utilize strings that have a loop end twisted around a metal grommet or have what is known as a "bullet" or "ball" end. These ends can be retained in a slot, hole, or other structure (not shown) in string block 30 in a generally known manner. Alternatively, a shaped bridge pin (not shown) may be used to maintain the string end at anchor point 29, as is also generally known. Bridge pins 25 are somewhat longer than traditional bridge pins so that each string is actually anchored to string block 30 and not sounding board top 17 or bridge plate 24. The manner or method of anchoring the string end to string block 30 is not part of the invention and therefore may be achieved in any known way.

It should also be mentioned that, while only a single string block 30 is shown in the present embodiment extending across two tone bars 28, there may be any number of string blocks and each string block may be supported by any number of tone bars. Furthermore, tone bars 28 may be to either side of the string block or may be positioned more toward the center.

It is believed that attaching the string end directly to the sound board interferes with the sound board function and interferes with acoustic coupling between the string and the tone bars. By attaching the string ends to string block 30, sounding board top 17 is relieved of large torsional forces normally exerted theragainst and vibrational energy of the strings 12 is transmitted directly to tone bars 28 via string block 30, thereby enhancing the volume and sound of the instrument.

It is to be understood that the present invention is not limited to the embodiment described above, but encompasses any and all embodiments within the scope of the following claims.

I claim:

1. An acoustic musical instrument, comprising:

a head having a tensioning device attached thereto;

a fingerboard extending from the head, the fingerboard having a plurality of frets;

a hollow body extending from the fingerboard and having a sounding board, a bottom board, and at least one side extending between the sounding board and the bottom board, the hollow body defining a sound chamber, the sounding board having a top surface and a bottom surface;

a bridge attached to the top surface of the sounding board;

a plurality of tone bars attached to the bottom surface of the sounding board;

at least two tone bars of the plurality of tone bars each having a notch formed therein;

a string block extending between said at least two tone bars of the plurality tone bars and spaced from said sounding board;

said string block being attached to each said notch;

at least one string having a first end attached to the tensioning device and having a second end; and means for anchoring the second end of the at least one string to the string block.

2. The acoustic musical instrument of claim 1, wherein said acoustic musical instrument is a guitar.

3. The acoustic musical instrument of claim 2, wherein said at least one string is a steel string.

4. The acoustic musical instrument according to claim 1, wherein said bridge further comprises a bridge plate having an aperture defined therein, said sounding board having an aperture defined therein aligned with the aperture defined in the bridge plate, said at least one string passing through the aligned aperture and being attached to said string block.

5. The acoustic musical instrument of claim 1, wherein said means for anchoring comprises a peg extending through said bridge and said sounding board and being fixed in said string block.

6. A method of stringing a musical instrument, comprising the steps of:

providing a musical instrument having a sounding board and a plurality of tone bars attached to a bottom surface of the sounding board, with at least two of the tone bars each having a notch formed therein;

attaching a string block between each said notch, the string block being spaced from and positioned beneath the sounding board;

anchoring a first end of each of a plurality of strings to the string block; and attaching a second end of each of said plurality of strings to a tensioning device.

7. The method of claim 6, wherein said anchoring step further comprises inserting a peg into an aperture formed in said string block.

8. The acoustic musical instrument of claim 1, wherein said string block is attached to each said notch by an adhesive.

* * * * *